US007819712B1

(12) United States Patent
Winter

(10) Patent No.: US 7,819,712 B1
(45) Date of Patent: Oct. 26, 2010

(54) MARKER BUOY

(76) Inventor: Lynn A. Winter, 10419 Decatur Cir., Bloomington, MN (US) 55438

( * ) Notice: Subject to any disclaimer, the term of this patent is extended or adjusted under 35 U.S.C. 154(b) by 65 days.

(21) Appl. No.: 12/380,921

(22) Filed: Mar. 5, 2009

(51) Int. Cl.
*B63B 22/16* (2006.01)

(52) U.S. Cl. ..... 441/6; 441/13; 441/23

(58) Field of Classification Search ..... 441/6, 441/13, 23, 26, 21; 43/17.5
See application file for complete search history.

(56) References Cited

U.S. PATENT DOCUMENTS

| | | | |
|---|---|---|---|
| 3,089,156 | A | 5/1963 | Hamm |
| 3,653,085 | A | 4/1972 | Rovner |
| 3,827,093 | A | 8/1974 | Davis |
| 4,074,380 | A | 2/1978 | Parker |
| 4,103,379 | A | 8/1978 | Wolfe |
| 4,405,303 | A | 9/1983 | Smith |
| 4,443,203 | A | 4/1984 | Maertens |
| 4,501,563 | A | 2/1985 | Johnson et al. |
| 4,501,564 | A | 2/1985 | Cairone, Sr. |
| 4,544,364 | A | 10/1985 | Bankston |
| 4,601,126 | A | 7/1986 | Klocksiem |
| 4,781,636 | A | 11/1988 | Schurr |
| 5,033,984 | A | 7/1991 | Shroeder |
| 5,188,551 | A | 2/1993 | Keller |
| 5,256,093 | A | 10/1993 | Balstad |
| 5,273,468 | A | 12/1993 | Nichols |
| 5,358,437 | A | 10/1994 | Allen |
| 5,376,035 | A | 12/1994 | Forrest |
| 5,613,888 | A | 3/1997 | Lamphere |
| 6,709,304 | B1 | 3/2004 | Young |
| 7,175,492 | B1 | 2/2007 | Butler |
| 7,311,575 | B1 | 12/2007 | Briles |

OTHER PUBLICATIONS

Cabella's catalog, 2008 Master Fishing Catalog, p. 268 showing the commercial embodiment of the rovner invention, or what is believed to be the Rovner invention.
Cabella's catalog, 2008 Master Fishing Catalog, p. 268 also showing a rectangular shaped (Best Buoy) marker buoy model.

*Primary Examiner*—Lars A Olson

(57) ABSTRACT

A simplified, self-setting marker buoy having an outer shell of abrasion-resistant plastic material, two end portions (14) that are filled with foam or hollow to provide buoyancy, an integrally formed medial portion (18) on which the anchor line (22) is wound, an anchor line (22), and an anchor weight (38). The medial portion (18) is slightly offset from the axis of rotation of the floatation unit (10) to provide rotational resistance to impede rotation of the floatation unit (10) and the resulting release of excess anchor line (22) due to the action of wind, waves, or currents. The amount of offset of the medial portion (18) is preselected to provide the maximum amount of rotational impedance that will still allow rotation of the floatation unit (10) while the anchor weight (38) descends to the bottom of the water body. The medial portion (18) also has a relatively large cross-sectional area resulting in greater ease in rewinding the anchor line (22) onto the medial portion (18). One or both of the end portions (14) can be hollow and composed of light-transmissive material with a removable cap (30) to allow access to install one or more removable lighting devices (34).

9 Claims, 3 Drawing Sheets

MARKER BUOY

CROSS-REFERENCE TO RELATED APPLICATIONS

Not Applicable

FEDERALLY SPONSORED RESEARCH

Not Applicable

SEQUENCE LISTING OR PROGRAM

Not Applicable

FIELD OF THE INVENTION

This invention relates to floating marker buoys that are anchored to the bottom of a water body to mark selected reference points of interest, and they generally include a self-setting feature used to prevent the further release of anchor line after the anchor has descended to the bottom of the water body, thus maintaining the marker at a position on the water surface nearly vertical from the anchor.

BACKGROUND OF THE INVENTION

Floating marker buoys are frequently used by fishermen, boaters, and others to mark specific reference points on the surface of a body of water, or to mark underwater features or objects. The most desired features of these marker buoys are high visibility, convenient use, and self-setting capability to prevent the further release of anchor line after the anchor has completed its descent to the bottom of the water body. In conjunction with the self-setting feature, the marker buoy should have sufficient rotational resistance to prevent further anchor line unwinding and the resultant drifting of the marker buoy due to the forces of wind, waves, or currents. The unit should also be simple and inexpensive to manufacture. Another useful feature is an optional light that can be installed and used in dim light conditions or at night.

There are several types of marker buoys currently on the market. They generally include a floatation unit attached to one end of an anchor line, and the other end of the anchor line is attached to a weighted anchor. One commonly used marker buoy is the barbell or dumbbell shaped unit having eccentric weights to provide rotational resistance to stabilize the marker buoy after the anchor has reached the bottom of the water body. An example of this type is disclosed by Rovner in U.S. Pat. No. 3,653,085, issued on Apr. 4, 1972. Another example is disclosed by Forrest in U.S. Pat. No. 5,376,035, issued on Dec. 27, 1994. Both the Rovner and the Forrest marker buoys have a small (approximately one inch) diameter medial portion on which the anchor line is wound. When the user retrieves the marker buoy, the anchor line is wet, and the user must hold the floatation unit in one hand, while he or she rewinds the anchor line around the medial portion with his other hand. The requisite small diameter of the medial portion and the wet line combine to make rewinding the anchor line a tedious, time consuming, and sometimes-uncomfortable task.

Both of these marker buoy units also incorporate eccentrically positioned weights inside of the floatation spheres to provide rotational impedance to prevent additional anchor line unwinding after the anchor has completed its descent to the bottom of the water body. This torque is needed to resist rotation due to the forces of wind, waves, or currents acting on the floatation unit. The addition of this eccentric weight results in added manufacturing cost and causes the floatation unit to float lower in the water, therefore reducing visibility.

While it would seem desirable to simply increase the diameter of the medial portion (or line storage spool) of currently available dumbbell shaped marker buoys, this would present problems. If, for example, the diameter of the line storage spool were to be doubled to approximately two inches, one would also have to double the eccentric weight in order to provide equivalent rotational impedance to resist further anchor line unwinding due to the forces of wind, waves, or currents. That would increase the weight and cost to manufacture the unit, and the marker buoy would then float ever lower in the water.

To overcome the difficulty of rewinding the anchor line on the small diameter medial portion or line storage spool, the Forrest unit includes an option feature whereby one can use a portable power hand tool to facilitate rewinding the anchor line, but many users may choose to forego using this option because it requires having a power tool on hand.

Another disadvantage is that neither of these two units is designed to be used with attached lights for improved visibility in dim light conditions or at night. Examples of lighted marker buoys are disclosed by Allen in U.S. Pat. No. 5,358,437, issued on Oct. 25, 1994; by Klocksiem in U.S. Pat. No. 4,601,126, issued Jul. 22, 1986; and by Bankston in U.S. Pat. No. 4,544,364, issued on Oct. 1, 1985. The marker unit by Allen requires the use of an unwinding reel that is counterweighted. The marker unit by Klocksiem has the light elements exteriorly mounted on the buoyant body where they are exposed to water and accidental damage. It also requires the use of eccentric weight. The marker unit by Bankston, with its rectangular shape, floats very low on the water surface providing poor visibility, especially if the water surface is choppy.

BRIEF SUMMARY OF THE INVENTION

The objects of the invention are:

(a) To provide a marker buoy that is simpler and less costly to manufacture.

(b) To provide a marker buoy that has self-setting capability and resists further rotation due to wind, waves, or currents after the anchor weight has descended to the bottom of the water body.

(c) To provide a marker buoy that can be configured to function well with a larger cross-sectional area of the medial portion that serves as the anchor line storage spool. A larger cross-sectional area of the line storage spool results in fewer coils of anchor line and much greater ease in rewinding the anchor line when retrieving the marker buoy to discontinue use.

(d) To eliminate the need for including eccentric weight within the body of the marker buoy. This weight is used in current dumbbell shaped models to provide rotational impedance to resist rotation and unwinding of excess anchor line due to wind, wave, or current action.

(e) To provide a marker buoy that floats higher on the water surface for improved visibility. This can be achieved by the elimination of the eccentric weight used in currently available dumbbell shaped marker buoys.

(f) To provide a marker buoy that can be equipped with one or two easily removable lights for use in dim light conditions or at night.

The invention is a self-setting marker buoy of the type used by fishermen, boaters, and others to mark the location of selected reference points on a water body. It comprises a floatation unit having two end portions and a medial portion on which the anchor line is wound. The end portions provide the majority of the buoyancy of the floatation unit.

The medial portion is integrally connected to the two end portions and is offset a preselected distance from the longitudinal axis of rotation of the two end portions to provide rotational impedance to the floatation unit to resist rotation due to the action of wind, waves, or currents after the anchor weight has completed its descent to the bottom of the water body. This unique offset or eccentric positioning of the medial portion with its wound anchor line provides the desired rotational resistance, thus eliminating the need for eccentric weight within the end portions. Without eccentric weight, the floatation unit floats higher on the water surface for enhanced visibility. By eliminating the eccentric weights, the floatation unit can be made hollow and transparent or translucent to enable the use of an attached light. Also, by eliminating the need for eccentric weight, the floatation unit is simpler and much less costly to manufacture.

The amount of offset or eccentricity of the medial portion can be selected to allow the use of a relatively large diameter or large cross-sectional area of the line-holding section of the medial portion. This results in much greater ease of rewinding the anchor line, with fewer coils required to rewind the anchor line.

The end portions and the medial portion can be hollow and composed of transparent or translucent plastic material. At least one of the two end portions can then have a removable cap to provide access for the installation of a removable light. When equipped with at least one removable light, the marker buoy can be more effectively used in dim light conditions or at night.

The marker buoy further comprises an anchor line attached to the floatation unit and normally wound around the medial portion, and an anchor weight attached to the other end of the anchor line.

The advantages of the invention are:

(a) With its unique eccentrically configured medial portion of the marker buoy on which the anchor line tension acts, this marker buoy does not require eccentric weight to provide rotational resistance to counteract the tension of the anchor line resulting from wind, wave, or current action. This novel non-concentric, asymmetrical configuration is a significant departure from the more symmetrical configuration of other dumbbell shaped marker buoys requiring counterweights.

(b) Without requiring eccentric weight, this marker buoy floats higher on the water surface for increased visibility.

(c) With the eccentrically positioned medial portion of the marker buoy on which the anchor line tension acts, sufficient rotational resistance can be provided to allow a much larger cross-sectional area of the medial portion which acts as the anchor line storage spool. This larger cross-sectional area, associated with fewer coils of anchor line, greatly enhances the ease of rewinding the anchor line after use, while also providing sufficient rotational impedance to resist excess line unwinding due to the action of wind, waves, or currents. The required small diameter of the medial portion of existing dumbbell shaped marker buoy units is a major disadvantage of currently available units. The small diameter of the medial portion of existing symmetrical dumbbell shaped units is necessary for those units to provide the desired rotational resistance to the forces of wind, waves, or currents.

(d) The diameter of the medial portion (line storage spool) affects the rotational torque acting on the marker buoy. The small diameter of existing dumbbell shaped markers with their large number of anchor line coils results in the actual diameter varying, depending upon how much line is wound onto the line storage spool. More line on the line storage spool increases the diameter and reduces the marker's resistance to rotation from the forces of wind, waves, or currents. The present invention has a relatively large line storage spool, so the cross-sectional area of the spool changes very little as line is wound or unwound. This produces more predictable and consistent performance.

(e) Without requiring eccentric weight within the marker buoy, this marker buoy is simpler and can be manufactured at less cost than presently used dumbbell shaped marker buoys.

(f) The hollow transparent or translucent floatation unit, having a removable cap, can provide access for the use of a removable lighting device for use in dim light conditions or at night.

These and other objects, features, aspects, and advantages of the invention will become more clearly understood from the following detailed description which, when read together with the appended drawings, disclose representative embodiments of the invention.

DRAWING REFERENCE NUMERALS OF THE COMPONENTS

| | Component |
|---|---|
| 10 | floatation unit |
| 14 | end portion |
| 18 | medial portion |
| 22 | anchor line |
| 26 | sleeve |
| 30 | cap |
| 34 | removable lighting device |
| 38 | anchor weight |

DETAILED DESCRIPTION OF THE INVENTION

Figure 1:
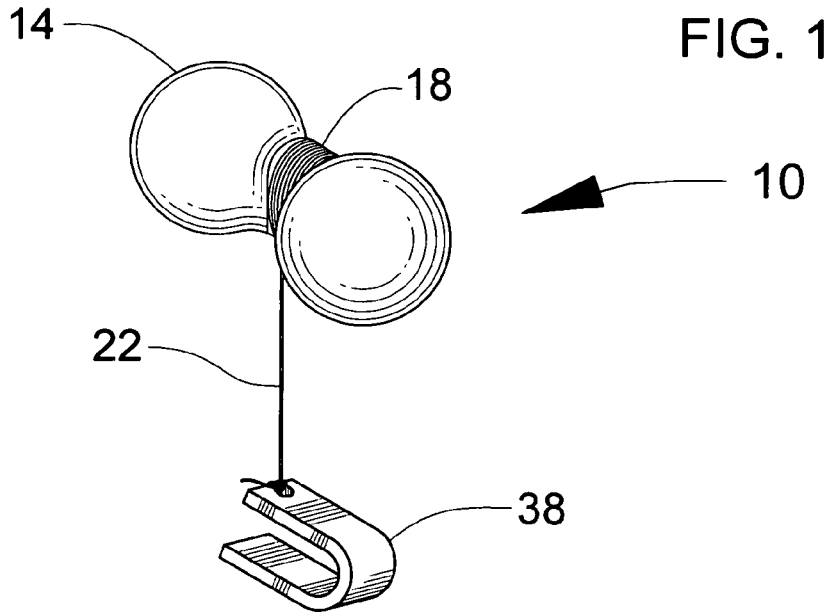
FIG. 1 is a perspective view of the first embodiment of the invention.

With reference to the drawings, and wherein like numerals designate like parts, and with particular reference to FIG. 1, a simplified, self-setting marker buoy is disclosed having a floatation unit generally indicated by reference numeral 10, comprising two end portions 14, an integrally formed medial portion 18, a length of anchor line 22, and an anchor weight 38. Floatation unit 10 can be composed of a variety of materials including materials having an abrasion-resistant outer shell of high-impact plastic or other durable, watertight plastic material, and may be air-filled or may be filed with air-entraining closed-cell foam material such as styrene to provide the necessary buoyancy.

Of course, when the marker buoy includes an interior light, it will be of a hollow, watertight shell configuration composed of transparent or translucent material to allow the passage of light. Fluorescent materials, colored pigments, and dyes can be incorporated into the material for enhanced visibility. Interior or exterior colored coatings or light-reflective materials of various types can also be used. The preferred manufacturing method is injection molding using a plastic material such as high-impact polystyrene or polyvinyl chloride.

End portions 14 can be generally shaped as truncated spheres, spheres, hemispheres, cubes, or other shapes. They can have circular, oval, or rectangular vertical cross-sections, and they can be slightly flattened to provide added rotational resistance. End portions 14 provide the majority of the buoyancy of floatation unit 10. One or both of end portions 14 may be hollow and have a sleeve 26, open at the attached end, threaded at the outer end, and having a mating threaded, removable cap 30 to provide access for the installation of removable lighting device 34 to be used at night or in dim light conditions. Removable cap 30 is preferably a threaded screw-on cap to provide a watertight closure of end portion 14 when screwed onto the outer end of threaded sleeve 26. Removable cap 30 can also be a snap-on watertight closure.

Removable lighting device 34 is a miniature, battery-powered light, light-emitting diode, or other suitable light-emitting device that can be securely held in place within cap 30 or other location within end portion 14. Removable lighting device 34 can be held in place in cap 30 using a magnetic connection, a friction-fit sleeve, a threaded screw-in socket fixedly attached within removable cap 30, or otherwise removably mounted in cap 30. Removable lighting device 34 is capable of producing continuous or intermittent diffused illumination through the transparent or translucent material of floatation unit 10. Removable lighting device 34 can also be one or more removable luminescent light sticks secured in place within floatation unit 10 or secured on the exterior thereof.

Anchor line 22 is of flexible, abrasion-resistant material such as nylon, Dacron, or high-strength fishing line. It can be slightly elastic or have an elastic segment at the anchor end to counteract the abrupt variations in line tension forces from wind, waves, or currents. The length of anchor line 22 is sufficient to correspond generally with the maximum water depth where the marker buoy is likely to be used.

Medial portion 18 may be an elongated sleeve having a generally circular, elliptical, rectangular, or other shape in vertical cross-section. Medial portion 18 serves as the anchor line storage spool and is integrally interconnected at each end thereof to one of end portions 14. Medial portion 18 can be straight and parallel to the longitudinal axis of rotation of floatation unit, or it can be slightly U-shaped or slightly V-shaped, provided that the center (line holding) section of medial portion 18 having the wound anchor line 22 must be offset a preselected distance from the longitudinal axis of rotation of floatation unit 10. The preselected offset configuration of medial portion 18 is such that at least one face of medial portion 18 is near the axis of rotation of floatation unit 10. This offset or eccentric configuration of medial portion 18 results in impeding the rotation of floatation unit 10, and the maximum impedance and maximum stability occurs in the course of each revolution at the position where the anchor line tension is pulling downward along that face of medial portion 18 which is nearest the axis of rotation of floatation unit 10. At this point in the revolution, the tension in anchor line 22 produces the least amount of rotational torque. The offset is preselected to cooperate operationally with the size and shape of the marker buoy and with the weight of anchor weight 38.

Figure 4:
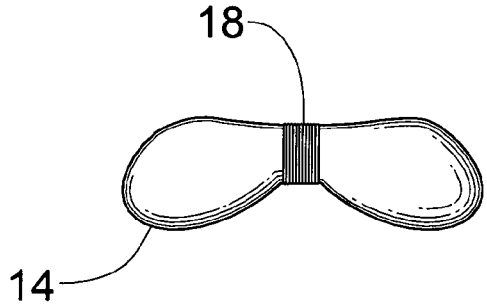
FIGS. 4 and 5 are a top plan view and a front elevation view respectively of a second embodiment or alternate shape of the invention. It can be seen from FIGS. 2 and 4 that, in both the first and second embodiments that the medial portion or line storage spool is offset somewhat rearward.
Figure 3:
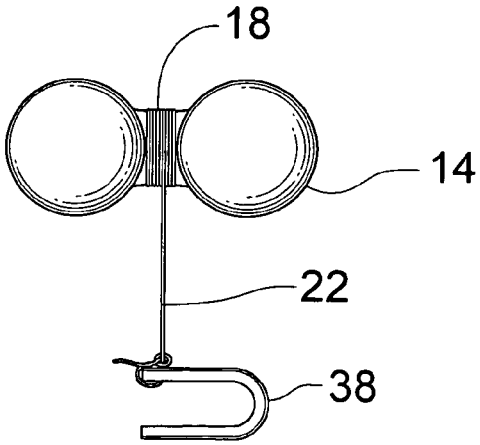
Figure 5:
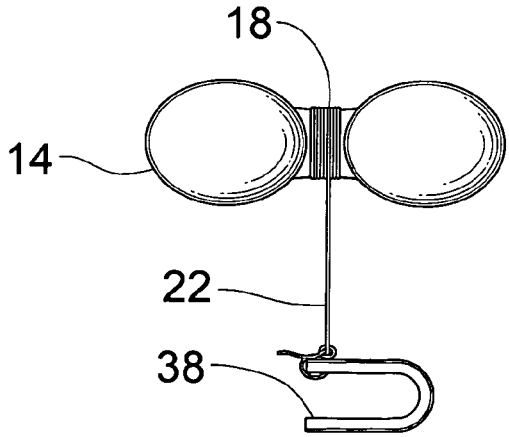
Figure 6:
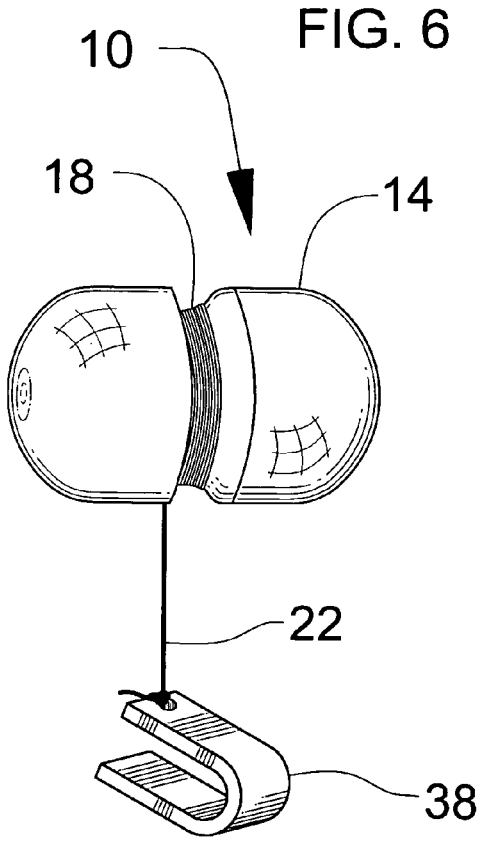
FIG. 6 is a perspective view of a third embodiment of the invention having an interior removable lighting device mounted inside of a threaded cap that can be screwed onto the marker buoy.
Figure 7:
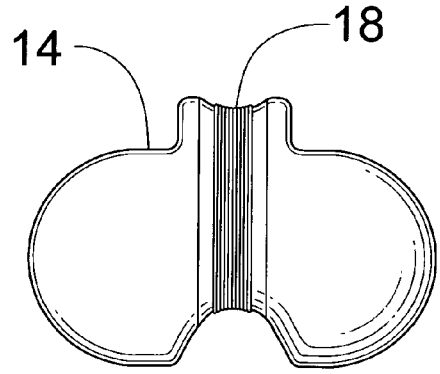
FIG. 7 is a perspective view of a fourth embodiment of the invention.
Figure 8:
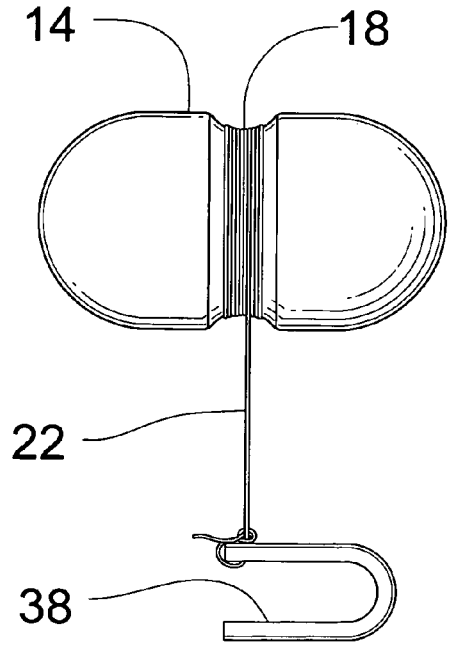
FIGS. 8 and 9 are a top plan view and a front elevation view respectively of the fourth embodiment of the invention illustrated in FIG. 7.

It is also contemplated, as illustrated in FIGS. 4 and 5, that floatation unit 10 can be slightly bent or slightly bowed in the horizontal plane, and that end portions 14 can be slightly flattened to provide additional resistance to rotation. A slight arc or slight angle in the horizontal plane of floatation unit 10 is advantageous in utilizing the buoyant force to help stabilize flotation unit 10 and to assist in impeding the rotation of floatation unit 10. The preferred cross-sectional configuration of medial portion 18 is semicircular or rectangular with rounded corners.

With the anchor line tension provided by anchor weight 38, the rotational impedance provided by the eccentric positioning of medial portion 18, in conjunction with the overall configuration of floatation unit 10, is slightly overcome to allow anchor weight 38 to descend to the bottom of the water body. However, when anchor weight 38 reaches the bottom of the water body, the tension in anchor line 22 is greatly reduced, and floatation unit 10 will float on the water surface where the eccentric positioning of medial portion 18 provides rotational resistance to impede further rotation of floatation unit 10 and the resulting unwinding of excess anchor line 22, despite the action of wind, waves, or currents. The phrase "rotational resistance or rotational impedance" is used herein to describe stabilizing torque or torque in the opposite direction from the rotational torque created by tension in anchor line 22 during the descent of anchor weight 38, and in the opposite direction from the rotational torque due to the line-unwinding forces of wind, waves, or currents.

Figure 2:
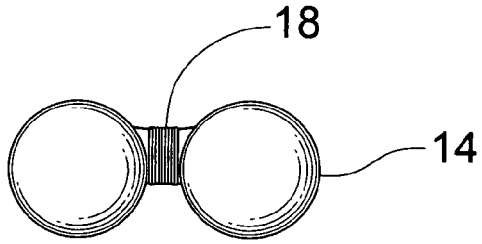
FIGS. 2 and 3 are a top plan view and a front elevation view respectively of the first embodiment of the invention illustrated in FIG. 1.

FIGS. 4 and 5 depict a top plan view and a front elevation view respectively of an alternate shape of the invention. One can see from FIGS. 2 and 4 that the medial portion 18 or line storage spool is offset rearward from the center of gravity of the outlined shape. This illustrates an important principle of how the invention can be made in various shapes if medial portion 18 is offset a preselected distance to provide the appropriate amount of rotational impedance. The offset distance of medial portion 18 depends upon the overall configuration and buoyancy forces of floatation unit 10 and the size of anchor weight 38. If medial portion 18 is offset too far, the anchor weight 38 will not produce sufficient rotational torque to cause the marker buoy to revolve and unwind anchor line 38. Conversely, if there is not sufficient offset, anchor line 22 will easily unwind, but the marker buoy will have reduced resistance to further undesirable rotation and line release after anchor weight 38 reaches the bottom of the water body. This invention incorporates an asymmetric or eccentric shape to provide the desired resistance to rotation, while other currently available dumbbell shaped units incorporate counterweights and, because of their symmetry, they require a wind-up spool or line storage spool of very small diameter in order to provide sufficient rotational resistance.

Figure 9:
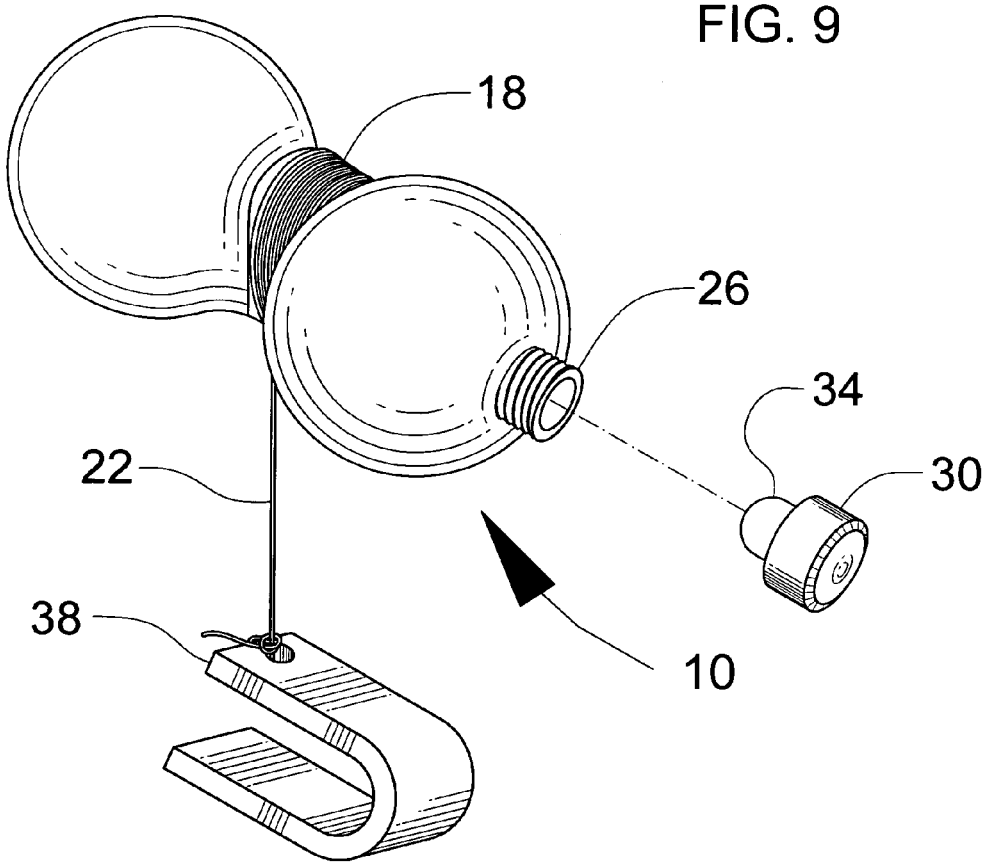
Figure 10:
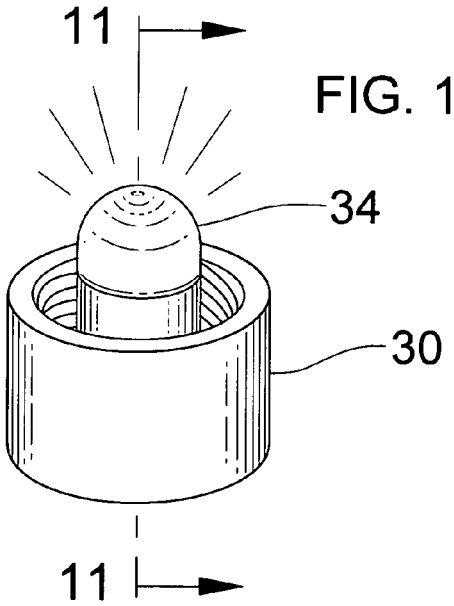
FIG. 10 is a perspective view of the screw-on cap with the removable lighting device attached within.
Figure 11:
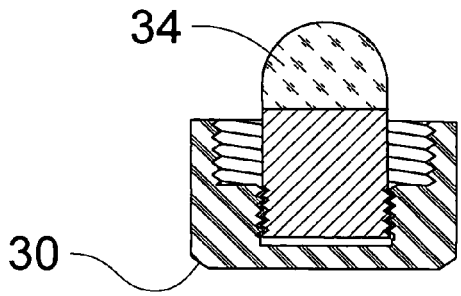
FIG. 11 is a vertical center sectional view taken along Line 11-11 of FIG. 10 showing the screw-on cap with the removable lighting device mounted therein.

FIGS. 9, 10, and 11 illustrate an embodiment with a screw-on cap having a removable lighting device mounted thereto.

In this embodiment, the entire floatation unit, including medial portion 18 is of hollow, transparent or translucent material to allow the passage of light. At times when illumination is not desired, lighting device 34 can be removed, and cap 30 can be installed tightly onto rigid sleeve 26 to provide a watertight fit. When removable lighting device 34 is needed, it can be attached within cap 30 before cap 30 is screwed onto sleeve 26.

Anchor weight 38 is of high specific gravity material, and of sufficient weight to just slightly overcome the rotational resistance resulting from medial portion 18 being eccentrically positioned, in order to allow anchor line 22 to unwind as anchor weight 38 descends to the bottom of the water body. After anchor weight 38 reaches the bottom of the water body, the tension in anchor line 22 is greatly reduced and the rotational resistance of floatation unit 10 prevents further undesirable rotation due to the action of wind, waves, or currents. Anchor weight 38 can be made of thin lead material, shaped and adapted to be easily bent and formed around wound anchor line 22 on medial portion 18 for secure and convenient storage when the marker buoy is not in use. Anchor weight 38 can also be made of steel, configured to fit snuggly around medial portion 18 for storage.

OPERATION AND USE OF THE INVENTION

When the user desires to use the marker buoy, he or she unbends anchor weight 38 to release it from its storage position over wound anchor line 22 on medial portion 18. If the user desires to use floatation unit 10 with removable lighting device 34, he or she removes cap 30 from sleeve 26 and installs removable lighting device 34 into cap 30. Then, he or she replaces cap 30 by securely screwing it onto sleeve 26 to form a watertight fit. Then the user places or tosses the marker buoy with its now disengaged anchor weight 38 onto the water surface at the selected location. The tension of anchor weight 38 on anchor line 22 causes torque on floatation unit 10 sufficient to just slightly overcome the rotational resistance provided by the offset medial portion 18 on which anchor line 22 is wound. Floatation unit 10 rotates on the surface of the water as anchor line 22 unwinds, and anchor weight 38 descends downwardly to the bottom of the water body. When anchor weight 38 completes its descent and settles on the bottom of the water body, the tension in anchor line 22 is greatly reduced and the rotational impedance provided by the offset medial portion 18 resists further rotation and unwinding of anchor line 22 despite the anchor line tension that may develop from the action of wind, waves, or currents. Floatation unit 10 is held at the selected location by anchor weight 38 until the user retrieves the marker buoy.

When the user wants to retrieve the marker buoy, he or she retrieves floatation unit 10 from the water surface. The user then holds floatation unit 10 in one hand and, with the other hand, winds anchor line 22 around medial portion 18. The line rewinding is greatly enhanced by the relatively large cross-sectional area of medial portion 18 requiring fewer coils to rewind anchor line 22. After anchor line 22 is rewound, the user bends anchor weight 38 around wound anchor line 22 on medial portion 18 to hold anchor weight 38 securely in place for convenient storage and to prevent inadvertent unwinding and tangling of anchor line 22 while the marker buoy is not being used.

CONCLUSION

The preferred configuration of the cross-section of the medial portion of the floatation unit is semicircular or rectangular with rounded corners; however, the medial portion can be of various cross-sectional shapes and sizes, provided that it is configured and positioned to provide the appropriate rotational resistance. The medial portion can be hollow or, if solid, the density of the medial portion can vary widely. Dense material can act as a counterweight to provide additional rotational resistance, however appropriate rotational resistance can be achieved by the novel eccentric configuration of the floatation unit alone, without requiring any counterweight.

While the above description contains many specifications, these should not be construed as limitations on the scope of the invention, but rather as an exemplification of the embodiments detailed herein. Other variations are possible. For example, the end portions of the floatation unit can be of various shapes and sizes. They can be generally shaped as truncated spheres, hemispheres, spheres, cubes, or other shapes. They can have generally semicircular, circular, oval, or rectangular vertical cross-sections. It is contemplated that the end portions can be slightly flattened or the floatation unit can be slightly angled or slightly bowed in the horizontal plane to provide added rotational resistance.

Workers skilled in the art will recognize additions, deletions, and other modifications that can be made in form and detail without departing from the spirit and scope of the invention. Thus, the scope of the invention should be determined by the appended claims, and not by the specific examples given.

From the above-described features, it should be evident that this invention with its novel eccentric configuration principle provides a number of significant advantages worthy of patentable merit over the prior art.

I claim:

1. A self-setting marker buoy for marking selected locations on a body of water, said marker buoy comprising:

an elongated, substantially air-filled, watertight floatation unit comprising two buoyant end portions of generally similar configurations, and an integrally formed connecting medial portion, said medial portion being disposed generally parallel to the longitudinal axis of rotation of said floatation unit and being disposed a preselected offset distance from said longitudinal axis of rotation, the eccentric positioning of said medial portion, in conjunction with the buoyant force of said body of water acting upon said floatation unit, imposing a preselected amount of rotational resistance to impede rotation of said floatation unit about said longitudinal axis of rotation;

a length of anchor line having one end thereof attached to said floatation unit, and being wound around said medial portion of said floatation unit; and an anchor weight of high specific gravity attached to the other end of said anchor line, said anchor weight being of sufficient weight to produce sufficient torque to slightly overcome said rotational resistance resulting from the eccentric configuration of said medial portion of said floatation unit, thus causing said floatation unit to rotate upon the surface of said body of water to allow unwinding of said anchor line while said anchor weight descends downwardly to the bottom of said body of water, after which said rotational resistance prevents further unwinding of said anchor line, whereby said floatation unit remains at a position nearly vertically above said anchor weight while resisting further rotation caused by from forces of wind, waves, or currents.

2. The marker buoy of claim 1 wherein said floatation unit is generally filled with air-entraining foam material to provide buoyancy.

3. The marker buoy of claim 1 wherein said end portions of said floatation unit are generally hollow.

4. The marker buoy of claim 1 wherein at least one of said end portions of said floatation unit are generally hollow and composed substantially of light transmissive material to allow the passage of light, further wherein at least one of said end portions has a removable cap configured to allow access for the installation of at least one removable lighting device.

5. The marker buoy of claim 4 wherein at least one of said end portions has at least one said removable lighting device capable of being securely held therein.

6. The marker buoy of claim 4 wherein at least one of said end portions has at least one said removable lighting device capable of being securely held within at least one said removable cap.

7. The marker buoy of claim 1 wherein both of said end portions and said medial portion of said floatation unit are generally hollow and composed substantially of light transmissive material to allow the passage of light, further wherein at least one of said end portions has a removable cap configured to allow access for the installation of at least one removable lighting device.

8. The marker buoy of claim 7 wherein at least one of said end portions has at least one said removable lighting device capable of being securely held therein.

9. The marker buoy of claim 7 wherein at least one of said end portions has at least one said removable lighting device capable of being securely held within at least one said removable cap.

* * * * *